US008246124B2

(12) United States Patent
Mackillop

(10) Patent No.: US 8,246,124 B2
(45) Date of Patent: Aug. 21, 2012

(54) DELIVERY STORAGE LOCKER

(75) Inventor: Brian Mackillop, Ile-Perrot (CA)

(73) Assignee: P.Riopel (1993) Inc., Montreal, Quebec (CA)

( * ) Notice: Subject to any disclaimer, the term of this patent is extended or adjusted under 35 U.S.C. 154(b) by 400 days.

(21) Appl. No.: 12/512,985

(22) Filed: Jul. 30, 2009

(65) Prior Publication Data

US 2010/0026147 A1 Feb. 4, 2010

(30) Foreign Application Priority Data

Aug. 1, 2008 (CA) ..... 2638481

(51) Int. Cl.
*E05C 9/10* (2006.01)
*A47G 29/16* (2006.01)

(52) U.S. Cl. ..... 312/216; 232/25

(58) Field of Classification Search ..... 312/215, 312/216, 222, 326; 232/24, 25, 44, 45; 292/137, 292/138, 340, DIG. 68
See application file for complete search history.

(56) References Cited

U.S. PATENT DOCUMENTS

| | | | | | |
|---|---|---|---|---|---|
| 353,008 | A * | 11/1886 | Sutliff | 232/25 |
| 618,846 | A * | 2/1899 | Crowder | 232/25 |
| 2,803,512 | A * | 8/1957 | Band | 312/298 |
| 3,893,740 | A * | 7/1975 | England | 312/216 |
| 4,161,274 | A * | 7/1979 | Bishop et al. | 232/24 |
| 4,965,551 | A * | 10/1990 | Box | 340/547 |
| 5,267,688 | A * | 12/1993 | Benefield | 232/17 |
| 5,794,844 | A * | 8/1998 | Jenkins | 232/25 |
| 6,247,641 | B1 * | 6/2001 | Noblet et al. | 232/17 |
| 2006/0151588 | A1 * | 7/2006 | Mikolajczyk et al. | 232/24 |
| 2006/0255116 | A1 * | 11/2006 | Yong | 232/24 |

* cited by examiner

*Primary Examiner* — James O. Hansen
*Assistant Examiner* — Sasha T Varghese
(74) *Attorney, Agent, or Firm* — Anglehart et al.

(57) ABSTRACT

The present document describes a storage locker in which a main lock having a movable latch may be installed. The storage locker comprises a housing defining a storage area having an opening. The storage locker also comprises a main door for covering the opening. The main door comprises a lock edge. The storage locker further comprises a back plate extending from the housing and a lock door linked to the back plate. The lock door is for covering the lock edge. The main lock is attached to the lock door. The storage locker further comprises a stop member attached to the back plate for acting as a stop limit for the latch to keep the lock door in the lock door closed position.

7 Claims, 7 Drawing Sheets

DELIVERY STORAGE LOCKER

TECHNICAL FIELD

This description relates to the field of lockable storage devices. More particularly, this description relates to group mailboxes having a lockable main door within which there is a plurality of individually lockable mailbox doors.

BACKGROUND

Existing lockable storage devices are prone to tampering by thieves who wish to gain access to items such as letters or packages being delivered to addressees. These storage devices often times include a main door giving access to a plurality of individual storage areas in which items can be placed for later pickup. The main door is normally locked and unlocked by delivery personnel. Some areas which can be tampered with include the hinge of the main door and any other edge around the periphery of the main door. In some installations, the main lock attachment (e.g., bolt heads) can also be tampered with to render the main lock useless. Generally, the area in which the main lock is installed must be fully secured.

There is therefore a need to overcome at least one of the drawbacks mentioned above and provide improvements therefor.

SUMMARY

According to an aspect of the description, there is provided a storage locker in which a main lock may be installed. The main lock has a movable latch. The storage locker comprises a housing defining a storage area having an opening. The storage locker also comprises a main door for covering the opening thereby defining a main door closed position. The main door comprises a lock edge. The storage locker further comprises a back plate extending from the housing in an area located along the lock edge when the main door is in the main door closed position. The storage locker also has a lock door linked to the back plate. The lock door is for covering the lock edge thereby defining a lock door closed position. The main lock is attached to the lock door. The storage locker further comprises a stop member attached to the back plate for acting as a stop limit for the latch to keep the lock door in the lock door closed position. The stop member being adjustable to provide a tight fit between the latch and the stop. Finally, the storage locker comprises a fixed stop extension attached to the back plate. The fixed stop extension comprising a slot through which the latch may travel. The slot providing another stop limit if the adjustable stop member is forced.

According to another embodiment, there is provided an add-on assembly for a storage locker of the type having a housing defining a storage area having an opening and a main door comprising a number of individual locker doors for covering the opening thereby defining a main door closed position, the main door comprising a lock edge opposite a hinge edge, one of the individual locker doors being used to contain a main lock for locking said main door in said closed position. The assembly comprises a back plate adapted to be mounted to the housing in an area located along the lock edge, a lock door linked to said back plate, the lock door for covering the lock edge thereby defining the lock door closed position, the lock door being adapted to receive the main lock, and a replacement door for the one of the individual locker doors previously used for the main lock.

BRIEF DESCRIPTION OF THE DRAWINGS

Further features and advantages of the present invention(s) will become apparent from the following detailed description, taken in combination with the appended drawings, in which.

It will be noted that throughout the appended drawings, like features are identified by like reference numerals.

DETAILED DESCRIPTION

Figure 1:
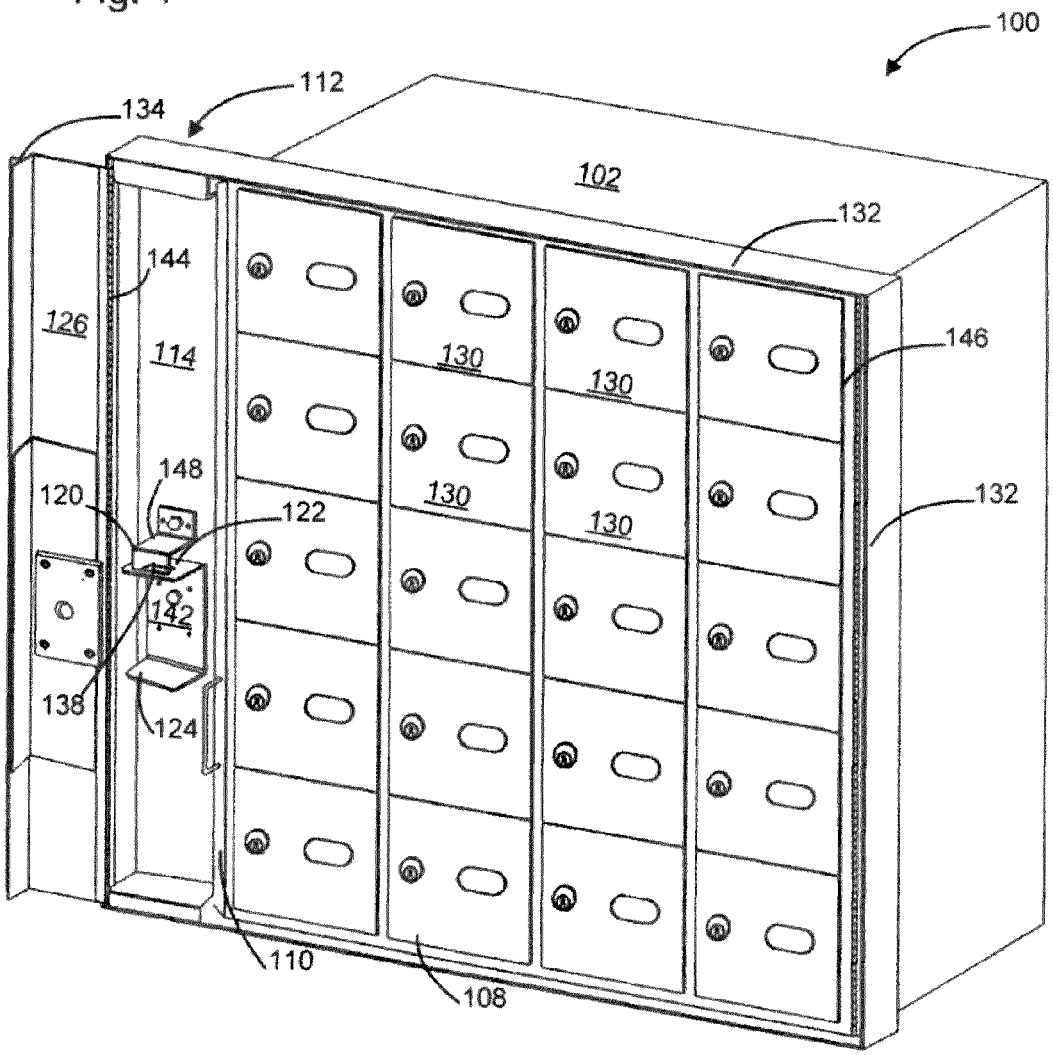
FIG. 1 is an isometric view of a storage locker according to an embodiment.

Referring now to the drawings and more particularly to FIGS. 1 to 4, there is shown a storage locker according to an embodiment of the invention. The storage locker 100 comprises a housing 102 which defines a storage area 106 having an opening 104 at the front of the housing 102. The storage area 106 is shown further divided into a plurality of smaller storage areas used, for example, for storing mail for the multitude of residents in a geographical area. The residents have access to their specific storage area via one of a plurality of mail box doors 130 in the main door 108. Each one of the mail box doors 130 has its own lock. The main door 108 is used for covering the opening 104. In this embodiment, the main door 108 is hinged to the housing 102 with hinge 146. When the main door 108 is in a position where it covers the opening 104, the main door 108 is in the main door closed position.

The storage locker 100 further comprises a lock area 112 which is used to install hardware which will provide a locking function for the main door 108.

FIG. 1 shows the storage locker 100 without the main lock 116 installed in the lock area 112. For some clients, this is the configuration in which the storage locker 100 will be delivered. These clients normally wish to install the main lock 116 themselves.

Figure 2:
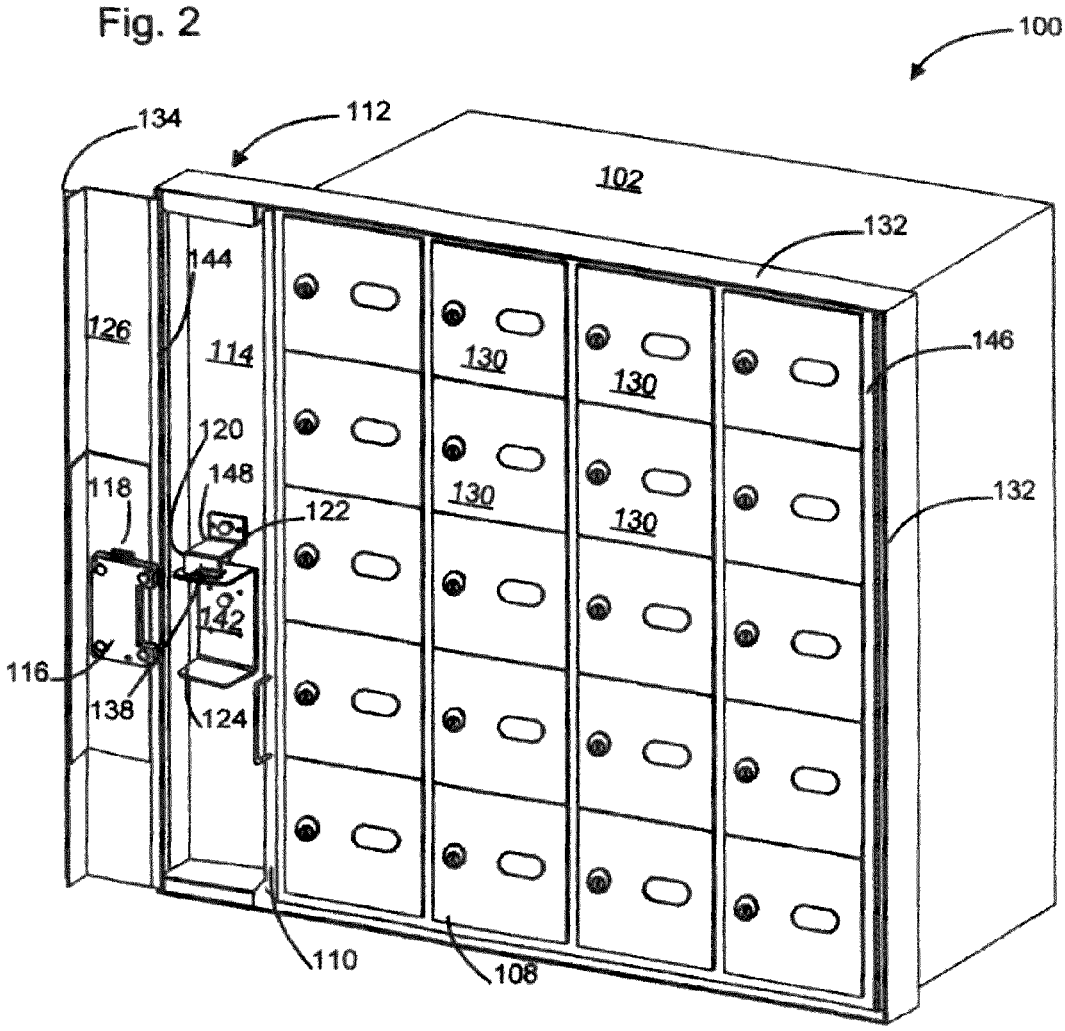
FIG. 2 is an isometric view of the storage locker of FIG. 1 in which a main lock is installed.
Figure 3:
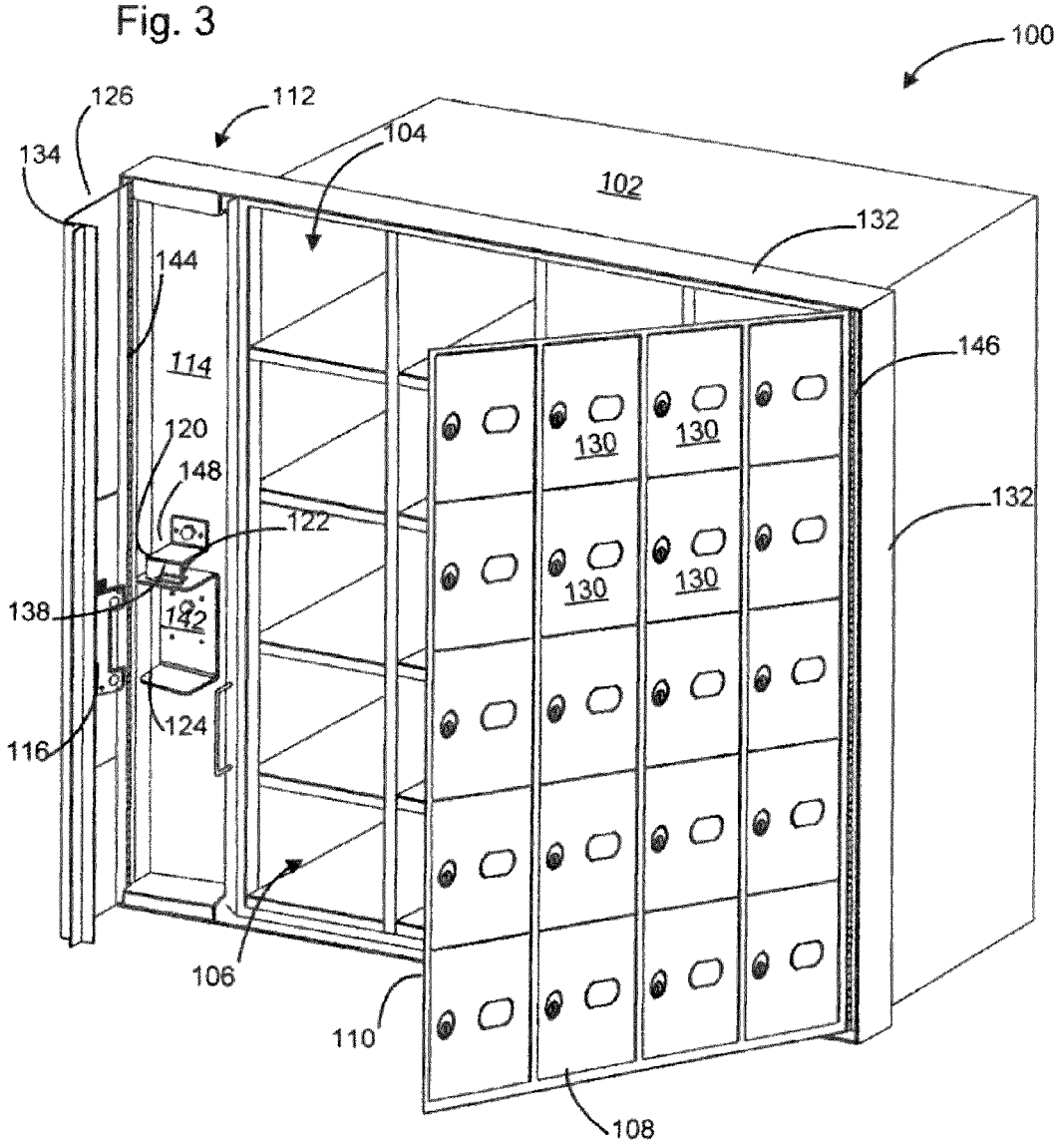
FIG. 3 is an isometric view of the storage locker of FIG. 1 showing the main door opened.
Figure 4:
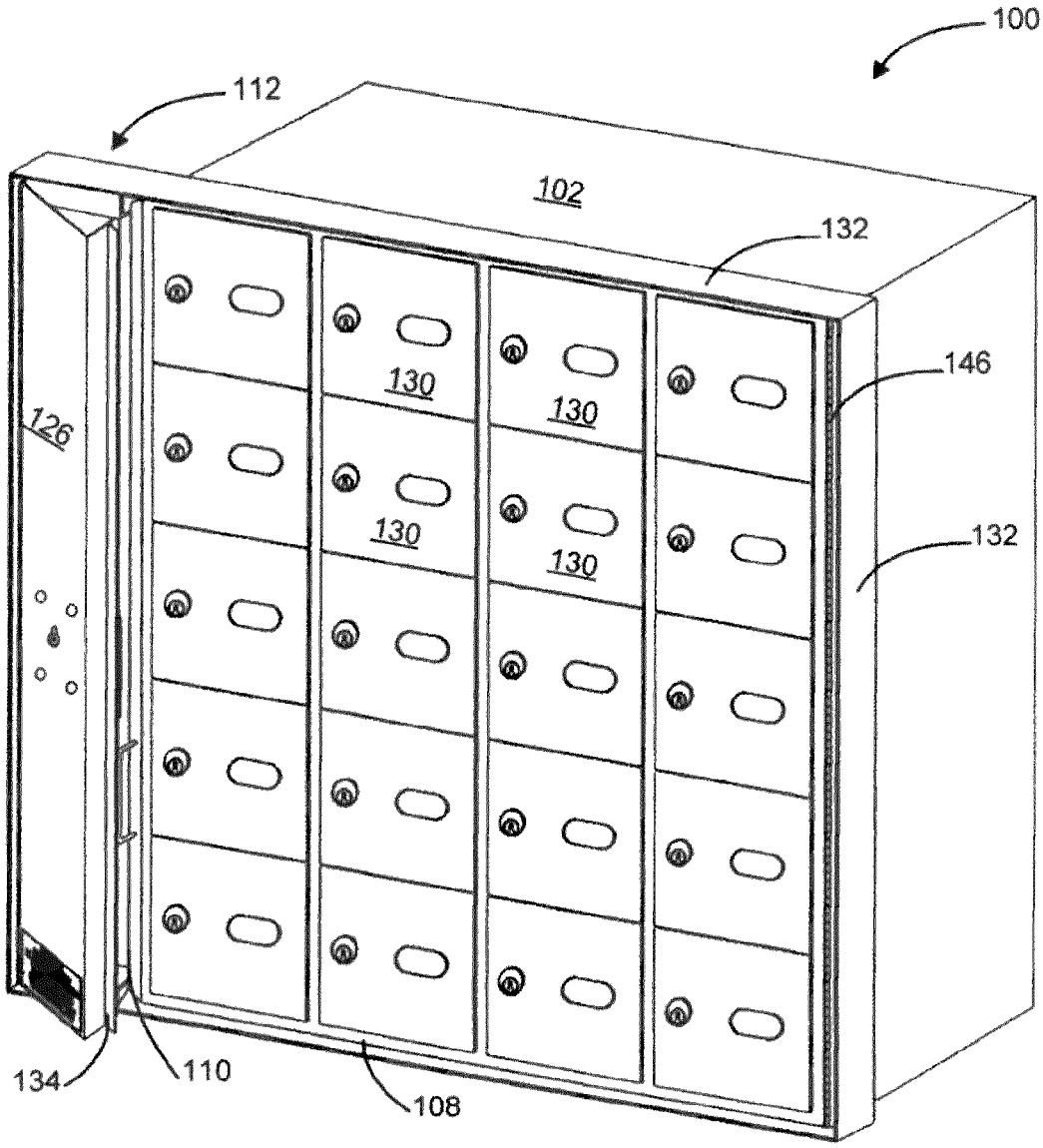
FIG. 4 is an isometric view of the storage locker of FIG. 2 showing the lock door being almost in the closed position.

FIGS. 1 to 3 further show a stop member 120 attached to the back plate 114. In this embodiment, the stop member 120 is a generally S-shaped bracket. A person skilled in the art will understand that the stop member 120 may assume various shapes. For example, the stop member 120 could also be an L-Shaped bracket having an edge welded to the back plate 114. The stop member 120 could also be a C-shaped channel that is either welded or bolted to the back plate 114.

Figure 6:
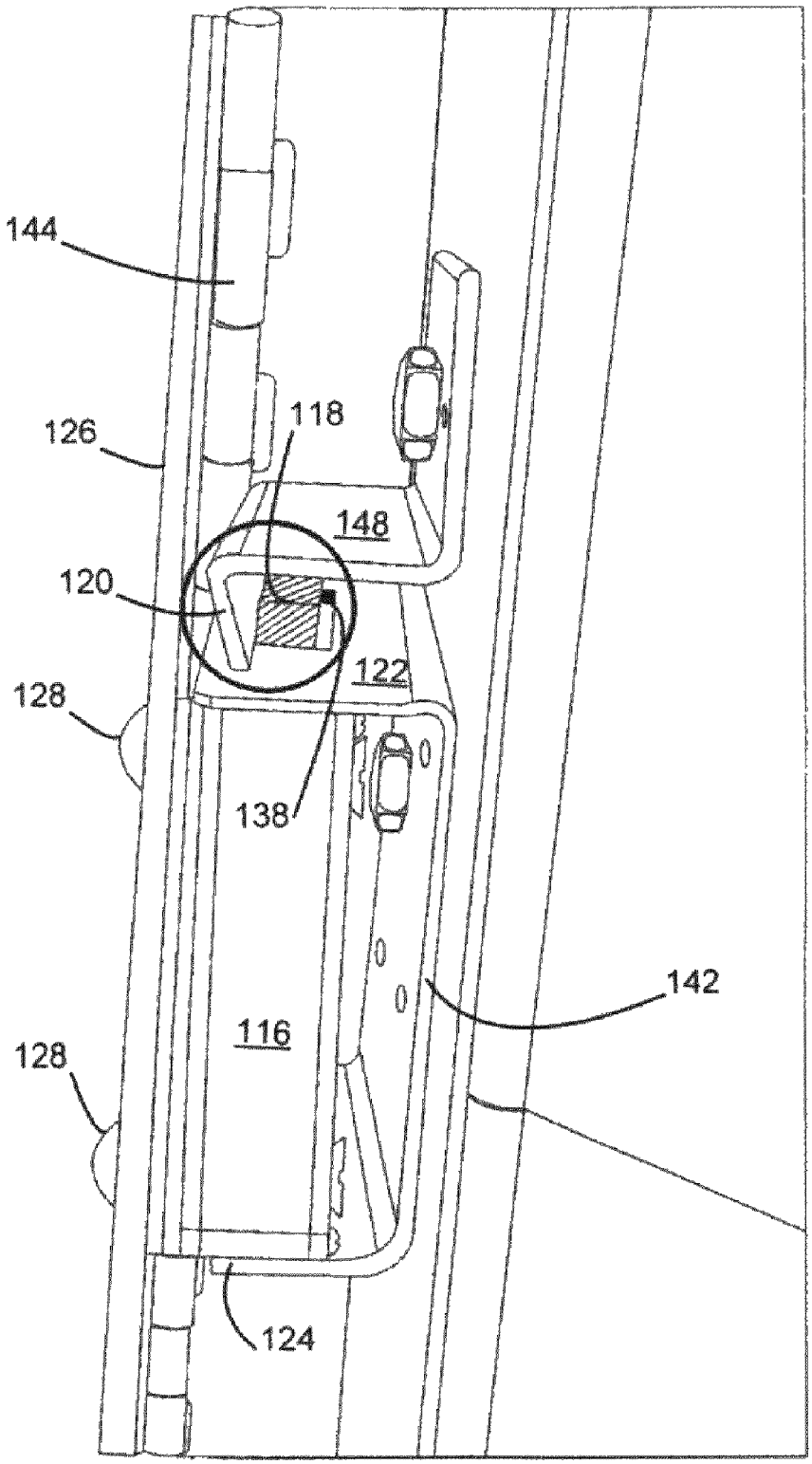
FIG. 6 is a partial perspective view of the lock area in which an adjustable stop member is installed.

There is further shown on FIGS. 1 to 3, a C-shaped channel 142 which comprises a first extension 122 and a second extension 124. The first extension 122 comprises a slot 138 through which the latch 118 of the lock 116 may travel. This is also shown in FIG. 6.

In FIG. 2, the lock 116 is shown installed on the lock door 126.

Now turning to FIG. 3, the main door 108 of the storage locker 100 is shown in a partially opened position. The lock door 126 for its part is shown approximately half-way to the lock door closed position.

In the embodiments of the invention shown on FIGS. 1 to 4, the lock door 126 is shown to be linked to the back plate 114 through a hinge 144. The lock door 126 is shown as a generally L-shaped channel. The larger surface of the L-shaped channel is for mounting the main lock 116 while the smaller surface of the L-shaped channel closes out the lock area 112 to provide protection from tampering with the main lock 116.

There is also shown on FIGS. 1 to 4 a lock lip 134 which extends from the smaller portion of the L-shaped channel of lock door 126. The lock lip 134 may be useful for interacting with the main door lock edge 110. A handle (not shown) may also be located at a lock edge 110 side of the main door 108. The handle is covered by the lock door 126 when in the lock door closed position.

FIGS. 1 to 4 also show a protection lip 132 which extends from the housing 102 to prevent access to all edges of the main door 108 except for the lock edge 110 which is protected by the lock door 126. The protection lip 132 also extends around a substantial portion of the edges of the back plate 114.

Now turning to FIGS. 5 to 8, there are described various embodiments for the hardware installed in the lock area 112.

Figure 5:
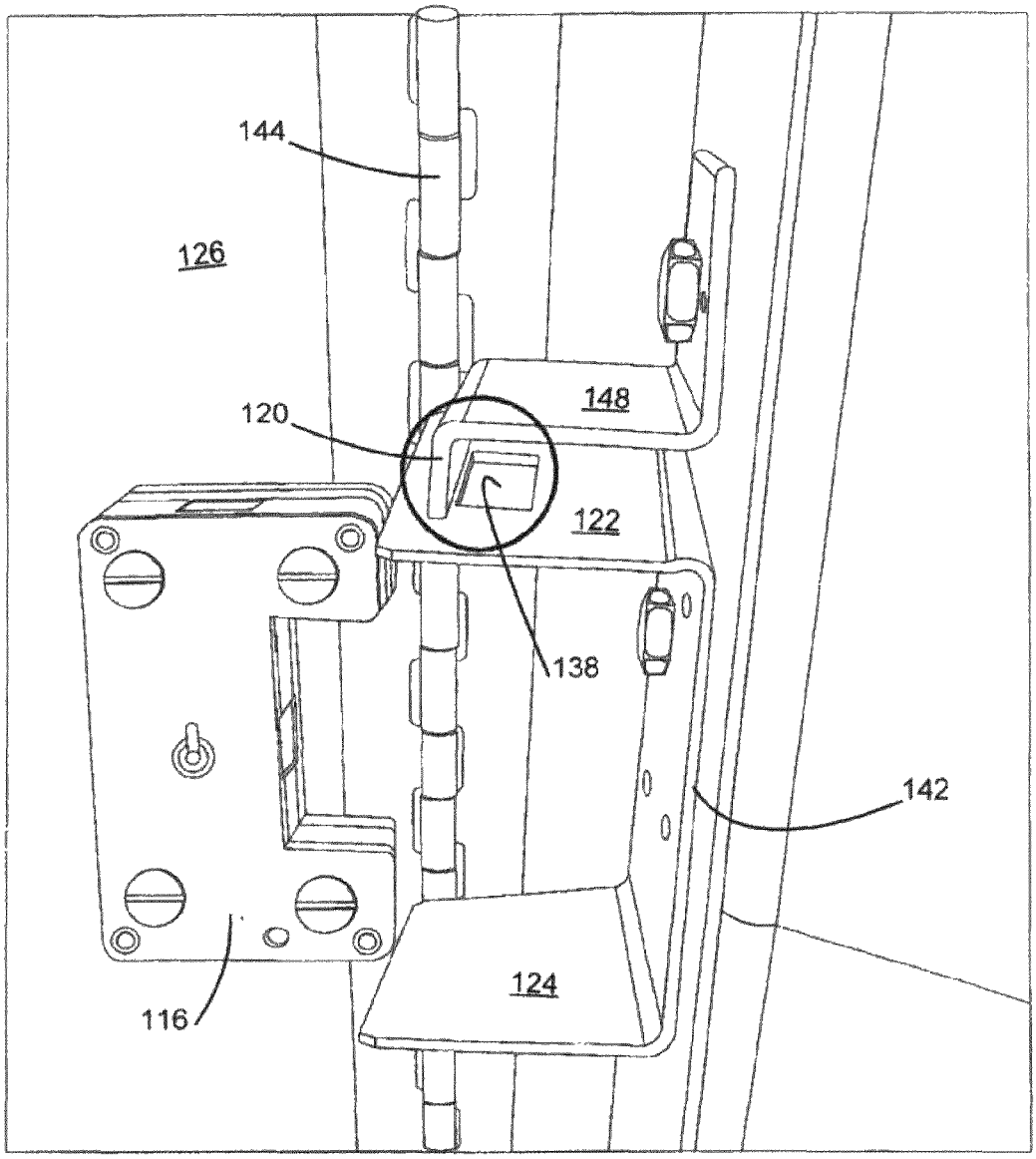
FIG. 5 is a perspective view showing a portion of the lock area in which a C-channel is installed and where the lock door is shown opened.

FIG. 5 shows a partial perspective view of the lock area 112. The lock 116 is installed on the lock door 126. The S-shaped bracket 148 is shown installed on the back plate 114 using a bolt. The S-shaped bracket 148 can also be spot welded to the back plate 114. S-shaped bracket 148 could also be installed using a combination of bolts and spot welding or any other type of welding. In the embodiment shown on FIG. 5, the S-shaped bracket 148 comprises the stop member 120. There is also shown, in FIG. 5, a C-shaped bracket 142, which comprises the first extension 122 and the second extension 124.

FIG. 6 shows the same hardware as in FIG. 5 while, in this case, the lock door 126 is in the closed position. In the present embodiment, the main lock 116 is installed by using bolts 128. The main lock 116 is shown to fit within the space provided by the C-shaped channel 142. The latch 118 is shown to extend through the slot 138. The stop member 120 acts as a stop limit for the latch 118 to keep the lock door 126 in the lock door closed position. When the operator, using his key, retracts the latch 118 into the main lock 116, the lock door 126 is free to be opened and hence the main door 108 is also free to be opened.

FIG. 6 also shows that the stop member 120 is adjustable to provide a tight fit between the latch 118 and the stop member 120. This adjustment is normally made on site by the technician installing the main lock 116.

According to an embodiment where the main lock 116 would be installed in a position where the latch 118 extends downwards instead of upwards, the stop member 120 would be installed below the main lock 116 and the first extension and second extension would form a single extension (not shown) located below the main lock 116. This single extension would function as a fixed stop.

According to another embodiment, a lock kit for installation on a storage locker 100 can be provided. Referring to FIG. 3, this embodiment shows the storage locker 100 which comprises a housing 102 defining a storage area 106 having an opening 104. The storage locker 100 also comprises a main door 108 for covering the opening 104 thereby defining a main door closed position. The main door 108 comprises a lock edge 110; a back plate 114 extending from the housing 102 in an area located along the lock edge 110 when the main door 108 is in the main door closed position; and a lock door 126 linked to the back plate 114. The lock door 126 is for covering the lock edge 110 thereby defining a lock door closed position. The lock kit comprises: a main lock 116 having a movable latch 118, the main lock 116 being for attachment to the lock door 126; a stop member 120 for attachment to the back plate 114 for acting as a stop limit for the latch 118 to keep the lock door 126 in the lock door closed position; a first extension 122 for attachment to the back plate 114. The first extension 114 comprises a slot 138 through which the latch 118 may travel when in the lock door closed position. The lock kit further comprises a second extension 124 for attachment to either one of the back plate 114 and the lock door 126. The second extension 124 is for providing a barrier to prevent tampering of the lock from the bottom.

Figure 7:
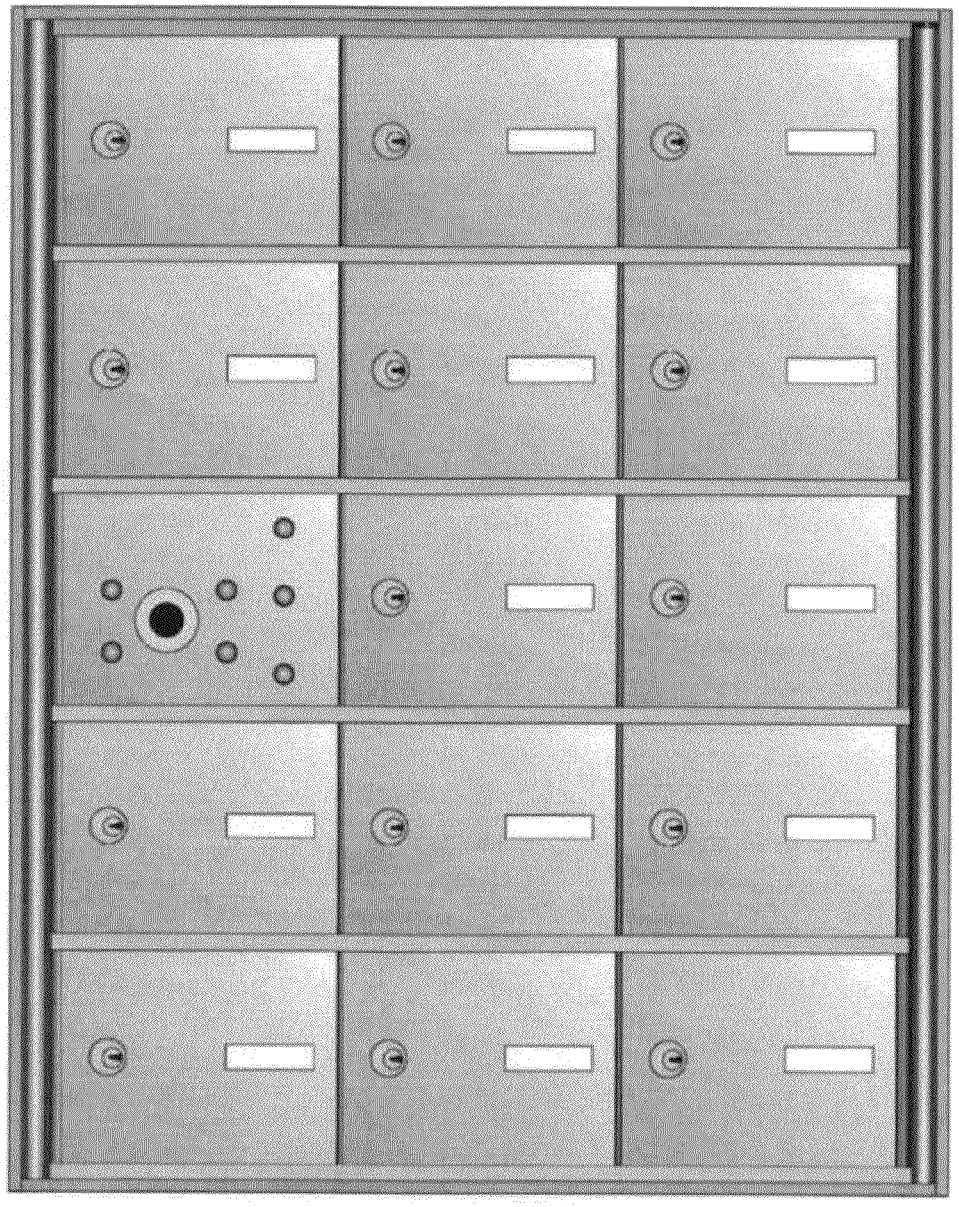
FIG. 7 shows a front view of a storage locker having an individual storage locker that is used for the purposes of the main lock in which the main lock is provided with a first adjustable stop and a second fixed stop.

According to a further embodiment, an add-on assembly for the storage locker of the type shown in FIG. 7 is provided. A back plate 114 can be adapted to be mounted to the housing in an area located along the lock edge. A lock door 126 can be linked to the back plate for the lock door to cover the lock edge thereby defining the lock door closed position. The lock door 126 can be adapted to receive the main lock that was mounted in one of the individual locker positions on the main door. A replacement individual locker door can be provided for the individual locker door once the main lock is moved to the lock door, and use of the one individual locker door can be gained. The resulting locker will resemble the locker of FIGS. 1 to 4, however, the frame or lip 132 may be separate from the add-on assembly.

While preferred embodiments of the invention were described above and illustrated in the accompanying drawings, it will be evident to those skilled in the art that modifications may be made therein without departing from the essence of this invention. Such modifications are considered as possible variants comprised in the scope of the invention.

What is claimed is:

1. A storage locker comprising:

a housing defining a storage area having an opening;

a main door comprising a number of individual locker doors for covering the opening thereby defining a main door closed position, the main door comprising a lock edge opposite a hinge edge;

a lock door for receiving a main lock with a movable latch for keeping said main door in the main door closed position;

a stop member for acting as a stop limit for the movable latch to keep the lock door in a lock door closed position, wherein the stop member is adjustable to provide a tight fit between the movable latch and the stop member; and a fixed stop extension comprising a slot through which the latch may travel, the slot providing another stop limit if the adjustable stop member is forced, wherein said stop member is positioned over said slot so that said movable latch can first engage said stop member and thereafter engage said fixed stop extension when attempting to open said lock door.

2. The locker as claimed in claim 1, wherein said lock door covers the lock edge in the lock door closed position.

3. The locker as claimed in claim 2, further comprising a back plate extending from the housing in an area located along the lock edge, said lock door being linked to said back plate.

4. The locker as claimed in claim 3, wherein said back plate and said lock door comprise an add-on assembly to said storage locker.

5. The locker as claimed in claim 3, wherein said stop member is an S-shaped member mounted to said back plate, said lock door being adapted to receive said main lock.

6. The locker as claimed in claim 2, further comprising a handle provided on said main door that is covered by said lock door in said lock door closed position.

7. The locker as claimed in claim 2, wherein the main door is mounted to be recessed within a frame of said housing in said lock door closed position, the lock door having an edge closing against said lock edge.

* * * * *